US009964878B2

(12) United States Patent
Ishikawa et al.

(10) Patent No.: US 9,964,878 B2
(45) Date of Patent: May 8, 2018

(54) CARRIER CORE MATERIAL AND ELECTROPHOTOGRAPHIC DEVELOPMENT CARRIER USING SAME AND ELECTROPHOTOGRAPHIC DEVELOPER

(71) Applicants: DOWA ELECTRONICS MATERIALS CO., LTD., Tokyo (JP); DOWA IP CREATION CO., LTD., Okayama-shi, Okayama (JP)

(72) Inventors: Yohei Ishikawa, Okayama (JP); Shinya Sasaki, Okayama (JP)

(73) Assignees: DOWA ELECTRONICS MATERIALS CO., LTD., Tokyo (JP); DOWA IP CREATION CO., LTD., Okayama (JP)

( * ) Notice: Subject to any disclaimer, the term of this patent is extended or adjusted under 35 U.S.C. 154(b) by 0 days. days.

(21) Appl. No.: 15/553,623

(22) PCT Filed: Mar. 1, 2016

(86) PCT No.: PCT/JP2016/056172
§ 371 (c)(1),
(2) Date: Aug. 25, 2017

(87) PCT Pub. No.: WO2016/140206
PCT Pub. Date: Sep. 9, 2016

(65) Prior Publication Data

US 2018/0052405 A1 Feb. 22, 2018

(30) Foreign Application Priority Data

Mar. 2, 2015 (JP) ..... 2015-039887

(51) Int. Cl.
*G03G 9/107* (2006.01)
*G03G 9/08* (2006.01)
*G03G 9/113* (2006.01)

(52) U.S. Cl.
CPC ..... *G03G 9/0827* (2013.01); *G03G 9/0819* (2013.01); *G03G 9/1075* (2013.01); *G03G 9/1132* (2013.01)

(58) Field of Classification Search
CPC ..... G03G 9/10; G03G 9/107; G03G 9/1075
See application file for complete search history.

(56) References Cited

U.S. PATENT DOCUMENTS 4,791,041 A * 12/1988 Aoki ..... G03G 9/107 428/407
2013/0004209 A1* 1/2013 Kishida ..... G03G 15/0921 399/277

FOREIGN PATENT DOCUMENTS

JP 2007-148452 A 6/2007
JP 2013-25204 A 2/2013

OTHER PUBLICATIONS

Apr. 19, 2016 International Search Report issued in International Patent Application No. PCT/JP2016/056172.

* cited by examiner

*Primary Examiner* — Peter L Vajda
(74) *Attorney, Agent, or Firm* — Oliff PLC

(57) ABSTRACT

A carrier core material is represented by a composition formula $M_xFe_{3-x}O_4$ (where M is Mn and/or Mg, and X is a total of Mn and Mg and is a substitution number of Fe by Mn and Mg, $0<X\leq1$), in which 5 to 20 number percent of bound particles where 2 to 5 spherical particles are bound together are contained and in which the maximum peak-to-trough depth Rz of the surface of normal spherical particles other than the bound particles is equal to or more than 1.5 μm but equal to or less than 2.1 μm. In this way, it is possible to increase the amount of toner supplied to a development region, and the surface of a photosensitive member is prevented from being scratched by a magnetic brush.

6 Claims, 4 Drawing Sheets

CARRIER CORE MATERIAL AND ELECTROPHOTOGRAPHIC DEVELOPMENT CARRIER USING SAME AND ELECTROPHOTOGRAPHIC DEVELOPER

TECHNICAL FIELD

The present invention relates to a carrier core material and an electrophotographic development carrier using such a carrier core material and an electrophotographic developer.

BACKGROUND ART

For example, in an image forming apparatus using an electrophotographic system, such as a facsimile, a printer or a copying machine, a toner is adhered to an electrostatic latent image formed on the surface of a photosensitive member to visualize it, the visualized image is transferred to a sheet or the like and thereafter it is fixed by being heated and pressurized. In terms of achieving high image quality and colorization, as a developer, a so-called two-component developer containing a carrier and a toner is widely used.

In a development system using a two-component developer, a carrier and a toner are agitated and mixed within a development device, and the toner is charged by friction so as to have a predetermined amount. Then, the developer is supplied to a rotating development roller, a magnetic brush is formed on the development roller and the toner is electrically moved to the photosensitive member through the magnetic brush to visualize the electrostatic latent image on the photosensitive member. The carrier after the movement of the toner is left on the development roller, and is mixed again with the toner within the development device. Hence, as the properties of the carrier, a magnetic property for forming the magnetic brush and a charging property for providing a desired charge to the toner are required. As such a carrier, a so-called coating carrier which is obtained by coating, with a resin, the surface of a carrier core material formed of magnetite, various types of ferrites or the like has so far been often used. The carrier core material which has so far been used for the coating carrier is formed in the shape of a perfect sphere.

In recent years, there has been a tendency that in order to cope with the market demand for increasing the speed of image formation in an image forming apparatus, the rotation speed of a development roller is increased such that the amount of developer supplied to a development region per unit time is increased.

However, in the coating carrier using the carrier core material in the shape of a perfect sphere, a failure is encountered in which the supply of the toner to the development region is insufficient and in which thus an image density is lowered. For example, a failure called development memory is encountered in which the image density is lowered by the influence of an image in the preceding revolution of the development roller.

Hence, a technology is proposed in which the surface of the carrier core material is formed in a concave-convex shape or different shapes of the carrier core material are formed, and in which thus frictional resistance to the surface of a photosensitive member and the frictional resistance of carriers are increased such that the amount of toner supplied to the development region is increased (for example, patent documents 1 and 2).

RELATED ART DOCUMENT

Patent Document

Patent Document 1: Japanese Unexamined Patent Application Publication No. 2013-25204

Patent Document 2: Japanese Unexamined Patent Application Publication No. 2007-148452

DISCLOSURE OF THE INVENTION

Problems to be Solved by the Invention

However, the concave-convex shape is only formed in the surface of the carrier core material, thus a coat resin is formed as a thick film in the concave portion when the surface of the carrier core material is coated with the resin and hence the concave and convex portions in the surface of the coating carrier are insufficient, with the result that the holding property of the toner is not sufficient. Although as carriers having different shapes, carriers which have an unequal polygonal shape or a massive shape are proposed, since the carriers have the extremely different shapes which deviate from a spherical shape, for example, the degree of the catching of the particles on each other is increased, a magnetic brush is hardened and the surface of the photosensitive member is rubbed with the magnetic brush, with the result that the surface of the photosensitive member may be scratched.

Hence, an object of the present invention is to provide a carrier core material which can increase the amount of toner supplied to a development region and in which the surface of a photosensitive member is prevented from being scratched with a magnetic brush.

Another object of the present invention is to provide an electrophotographic development carrier and an electrophotographic developer which can stably form satisfactory quality images even in long-term use.

Means for Solving the Problem

According to the present invention, there is provided a carrier core material that is represented by a composition formula $M_xFe_{3-x}O_4$ (where M is Mn and/or Mg, and X is a total of Mn and Mg and is a substitution number of Fe by Mn and Mg, $0<X\leq1$), where 5 to 20 number percent of bound particles in which 2 to 5 spherical particles are bound together are contained, and where the maximum peak-to-trough depth Rz of the surface of normal spherical particles other than the bound particles is equal to or more than 1.5 μm but equal to or less than 2.1 μm. A method of measuring the maximum peak-to-trough depth Rz in the carrier core material will be described in examples to be discussed later. In the present specification, unless otherwise particularly specified, "to" is used to mean that values mentioned before and after the "to" are included as the lower limit value and the upper limit value.

In the carrier core material according to the present invention, a volume average particle diameter (hereinafter also simply referred to as an "average particle diameter") is preferably equal to or more than 25 μm but less than 50 μm.

Moreover, according to the present invention, there is provided an electrophotographic development carrier, where the surface of the carrier core material described above is coated with a resin.

Furthermore, according to the present invention, there is provided an electrophotographic developer including: the electrophotographic development carrier described above; and a toner.

Advantages of the Invention

According to the carrier core material of the present invention, it is possible to increase the amount of toner supplied to a development region and reduce the occurrence of development memory. Moreover, the surface of a photosensitive member is prevented from being scratched with a magnetic brush. In this way, with a developer containing the carrier core material according to the present invention, it is possible to stably form satisfactory quality images even in long-term use.

DESCRIPTION OF EMBODIMENTS

Figure 1:
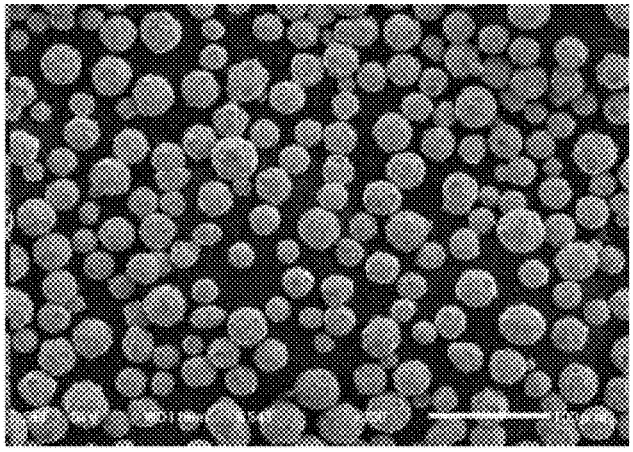
FIG. 1 A SEM photograph of a carrier core material in example 1.

The present inventors et al. have conducted a thorough study of increasing the amount of toner supplied to a development region without the surface of a photosensitive member being scratched with a magnetic brush, and consequently have found that a predetermined number of bound particles in which a few ferrite spherical particles are bound together are preferably contained as a content in a carrier core material, with the result that the present invention is achieved. Specifically, a carrier core material according to the present invention is a carrier core material that is represented by a composition formula $M_xFe_{3-x}O_4$ (where M is Mn and/or Mg, and X is a total of Mn and Mg and is a substitution number of Fe by Mn and Mg, $0<X\leq1$), 5 to 20 number percent of bound particles in which 2 to 5 spherical particles are bound together are contained and the maximum peak-to-trough depth Rz of the surface of normal spherical particles other than the bound particles is equal to or more than 1.5 μm but equal to or less than 2.1 μm. The carrier core material is a powder which is formed with ferrite particles, and here the ferrite particles other than the bound particles of the present invention are assumed to be normal spherical particles.

When a predetermined number of bound particles in which 2 to 5 spherical particles are bound together and which have different shapes that significantly deviate from a spherical shape are contained as a content in the carrier core material, spaces in which a toner is captured can be produced between the normal spherical particles and the bound particles. Then, the toner captured in the spaces between the normal spherical particles and the bound particles is transported by the rotation of a development roller to a development region, and the toner captured in the spaces appears on the surface of a magnetic brush and contributes to development. Moreover, unlike the conventional carrier of an unequal polygonal shape or a massive shape, the bound particles used in the present invention do not have corner portions because the bound particles are particles obtained by binding together spherical particles. Hence, even when the surface of a photosensitive member is rubbed with the magnetic brush, the surface of the photosensitive member is prevented from being scratched with the corner portions of the particles.

Although the individual particle diameters of the spherical particles forming the bound particle are not particularly limited, the bound particle is preferably a particle in which a mother particle whose particle diameter is the largest and 1 to 4 child particles whose particle diameters are smaller than that of the mother particle are bound together. Furthermore, the bound particle is preferably a particle in which the particle diameter of at least one child particle is larger than a half of the particle diameter of the mother particle. A predetermined proportion of the bound particles described above are contained in the carrier core material, thus the spaces between the normal spherical particles and the bound particles in which the toner can be captured and the spaces between the bound particles are increased in size and hence a larger amount of toner is transported to the development roller, with the result that it is possible to effectively reduce the occurrence of development memory.

Since the bound particle is present in a form in which a bound portion is shared by the mother particle and the child particles, the particle diameters of the mother particle and the child particle were individually calculated by approximating the particle to a spherical shape from a region obtained by removing the bound portion of the bound particle in an image that was obtained by shooting the shape of the carrier core material with a scanning electron microscope (JSM-6510LA made by JEOL Ltd.) at a magnification of 250.

In the bound particle used in the present invention, the compositions of the mother particle and the child particle may be the same as each other or may be different from each other.

For example, the bound particles described above can be obtained by, in a process of manufacturing the carrier core material which will be described later, increasing a holding time at a calcination temperature or adjusting a disintegration operation after the calcination. With this method, it is possible to easily adjust the content of the bound particles in the carrier core material.

Alternatively, the bound particles can be obtained by, in the process of manufacturing the carrier core material, mixing and calcining granulated materials which have different average particle diameters. With this method, it is possible to easily adjust the content of the bound particles in the carrier core material and simultaneously to easily adjust the particle diameters of the mother particle and the child particle to the desired particle diameters.

The content of the bound particles in the carrier core material is 5 to 20 number percent. When the content of the bound particles is less than 5 number percent, the amount of toner supplied to the development region may be insufficient whereas when the content of the bound particles exceeds 20 number percent, the fluidity of the carrier core material is excessively degraded, and thus the circulation and movement of the carrier within the magnetic brush are not sufficiently performed, with the result that when the speed of image formation is increased, it is impossible to obtain a sufficient image density. More preferably, the content of the bound particles falls within a range of 10 to 20 number percent.

The maximum peak-to-trough depth Rz of the surface of the normal spherical particles other than the bound particles in the carrier core material of the present invention is equal to or more than 1.5 μm. When the maximum peak-to-trough depth Rz of the surface of the normal spherical particles is equal to or more than 1.5 μm, the spaces formed between the normal spherical particles are increased in size and a larger amount of toner is captured in the spaces so as to increase the amount of toner transported to the development region, with the result that a failure of an image such as development memory is more reduced. The upper limit value of the maximum peak-to-trough depth Rz of the surface of the particles is preferably 2.1 μm, and is more preferably 1.9 μm. The maximum peak-to-trough depth Rz of the surface of the spherical particles is preferably adjusted such as by the content of Sr and the conditions of sintering in the manufacturing process. The details thereof will be described later.

The volume average particle diameter of the carrier core material of the present invention preferably falls within a range which is equal to or more than 25 μm but less than 50 μm, and more preferably falls within a range which is equal to or more than 30 μm but equal to or less than 40 μm.

Although a method of manufacturing the carrier core material of the present invention is not particularly limited, a manufacturing method which will be described below is preferable.

First, a Fe component raw material, a Mn component raw material, a Mg component raw material and as necessary, an additive are weighed, are put into a dispersion medium and are mixed, and thus slurry is produced. As the Fe component raw material, $Fe_2O_3$ or the like is preferably used. As the Mn component raw material, $MnCO_3$, $Mn_3O_4$ or the like is used. As the Mg component raw material, MgO or $Mg(OH)_2$ can be preferably used.

Here, in order for the surface of the ferrite particles to have a predetermined maximum peak-to-trough depth, a small amount of Sr is added. A small amount of Sr is added to partially generate Sr ferrite in the calcination process and thus a magnetoplumbite-type crystal structure is formed, with the result that a concave-convex shape in the surface of the ferrite particles is more likely to be facilitated. The added amount of Sr is in a range of 0.3 mol % to 0.8 mol % with respect to 100 mol % of the main component of the ferrite particle by conversion to SrO. When the added amount of SrO is less than 0.3 mol %, the maximum peak-to-trough depth Rz is decreased, and thus the spaces formed between the normal spherical particles are decreased in size. On the other hand, when the added amount of SrO exceeds 0.8 mol %, the amount of Sr ferrite generated is increased, and thus in the surface of the ferrite particles, excessively concave and convex portions are more likely to be formed. Consequently, the spaces formed between the normal spherical particles are increased in size but the corner portions are formed, with the result that when the surface of the photosensitive member is rubbed with the magnetic brush, the surface of the photosensitive member may be scratched with the corner portions of the particles. Furthermore, it is not preferable to do so because a magnetic force is lowered or a coercive force is increased. As a Sr component raw material, $SrCO_3$ can be preferably used.

Then, the raw materials are put into the dispersion medium so as to produce the slurry. As the dispersion medium used in the present invention, water is preferable. The calcination raw material described above and as necessary a binder, a dispersant and the like may be mixed into the dispersion medium. As the binder, for example, polyvinyl alcohol can be preferably used. As the amount of binder mixed, the concentration of the binder in the slurry is preferably set to about 0.5 to 2 mass %. As the dispersant, for example, polycarboxylic acid ammonium or the like can be preferably used. As the amount of dispersant mixed, the concentration of the dispersant in the slurry is preferably set to about 0.5 to 2 mass %. In addition, a lubricant, a sintering accelerator and the like may be mixed. The solid content concentration of the slurry preferably falls within a range of 50 to 90 mass %. The solid content concentration of the slurry more preferably falls within a range of 60 to 80 mass %. When the solid content concentration of the slurry is equal to or more than 60 mass %, a small number of pores within the particles are produced in the granulated material, and thus it is possible to prevent the insufficient of sintering at the time of the calcination.

After the raw materials weighed are mixed and calcined, they may be put into the dispersion medium so as to produce the slurry. The temperature of the calcination preferably falls within a range of 750 to 900° C. When the temperature of the calcination is equal to or more than 750° C., the partial change of the raw materials into a ferrite caused by the calcination proceeds, only a small amount of gas is generated at the time of the calcination, a reaction between the solids sufficiently proceeds and hence the temperature is preferably equal to or more than 750° C. On the other hand, when the temperature of the calcination is equal to or less than 900° C., the degree of sintering caused by the calcination is low, thus it is possible to sufficiently mill the raw materials in the subsequent slurry milling step and hence the temperature is preferably equal to or less than 900° C. As an atmosphere at the time of the calcination, the atmosphere is preferable.

Then, the slurry produced as described above is wet-milled. For example, a ball mill or a vibration mill is used to perform wet-milling for a predetermined time. The average particle diameter of the milled raw materials is preferably equal to or less than 5 μm and is more preferably equal to or less than 1 μm. Within the vibration mill or the ball mill, a medium having a predetermined particle diameter is preferably present. Examples of the material of the medium include an iron-based chromium steel and an oxide-based zirconia, titania and alumina. As the form of the milling step, either of a continuous type and a batch type may be used. The particle diameter of the milled material is adjusted such as by a milling time, a rotation speed, the material and the particle diameter of the medium used.

Then, the milled slurry is granulated by being sprayed and dried. Specifically, the slurry is introduced into a spray drying machine such as a spray dryer, is sprayed into the atmosphere and is thereby granulated into a spherical shape. The temperature of the atmosphere at the time of the spray drying preferably falls within a range of 100 to 300° C. In this way, it is possible to obtain a spherical granulated material having a particle diameter of 10 to 200 μm. Then, the obtained granulated material is classified with a vibrating screen, and thus the granulated material is produced so as to have a predetermined particle diameter range.

Here, the granulated material which has a large particle diameter after being screened may be used as the mother particle, and the granulated material which has a small particle diameter may be used as the child particle. By this operation, it is possible to control the particle diameters of the mother particle and the child particle even with the classification.

For example, when the mother particle having a particle diameter of 100 μm and the child particle having a particle diameter of 50 μm are produced, a stainless steel sieve which has a sieve opening of 103 μm is used to first classify the granulated material into the granulated material on the sieve and the granulated material under the sieve. Then, the granulated material on the sieve is used as the raw material for the mother particle. On the other hand, the granulated material under the sieve is further classified with a stainless steel sieve which has a sieve opening of 74 μm, and the granulated material under the sieve is used as the raw material for the child particle.

The granulated raw material for the mother particle and the granulated raw material for the child particle are mixed in a predetermined proportion so as to produce a predetermined proportion of the bound particles. In the particle size distribution of the mixed raw material obtained in this way, a plurality of peaks which are not obtained by a normal operation are seen or the particle size distribution is brought into the state of the distribution of different shapes. Although in the mixed raw material, the child particles and the mother particles are temporarily bound together by the mixing operation, it is not particularly necessary to use a binder for the binding, and in a subsequent sintering step, the mother particles and the child particles are mixed so as to be adjacent to each other.

Then, the granulated material described above is put into a furnace heated to a predetermined temperature, and is calcined by a general method for synthesizing ferrite particles, and thus ferrite particles are generated. The calcination temperature preferably falls within a range of 1100 to 1300° C. When the calcination temperature is equal to or less than 1100° C., it is unlikely that phase transformation occurs and that sintering proceeds. When the calcination temperature exceeds 1300° C., excessive grains may be generated by excessive sintering. The content of the bound particles can also be adjusted by the holding time at the calcination temperature, and in general, as the holding time is prolonged, the content of the bound particles is increased. Likewise, the maximum peak-to-trough depth Rz of the surface of the particles caused by the generation of the Sr ferrite in the ferrite particles can also be adjusted by the holding time at the calcination temperature, and in general, as the holding time is prolonged, the maximum peak-to-trough depth Rz is increased. As the holding time, 3 or more hours are preferable, and 6 or more hours are more preferable. The rate of temperature increase to the calcination temperature preferably falls within a range of 250 to 500° C./h. The concentration of oxygen in the calcination step is preferably controlled to fall within a range of 0.05 to 5%.

The calcined material obtained as described above is disintegrated. Specifically, for example, a hammer mill or the like is used to disintegrate the calcined material. As the form of the disintegration step, either of a continuous type and a batch type may be used. By the disintegration processing described above, the content of the bound particles can also be adjusted. In other words, as an impact force applied to the calcined material is increased and prolonged, the binding of the bound particles is released, and thus the content of the bound particles is reduced.

After the disintegration processing, as necessary, classification may be performed such that the particle diameters are made to fall within a predetermined range. As a classification method, a conventional known method such as air classification or sieve classification can be used. After primary classification is performed with an air classifier, with a vibration sieve or an ultrasonic sieve, the particle diameters may be made to fall into the predetermined range.

Furthermore, after the classification step, non-magnetic particles may be removed with a magnetic beneficiation machine. The particle diameter of the ferrite particle is preferably equal to or more than 25 μm but less than 50 μm.

Thereafter, as necessary, the ferrite particles after the classification are heated in an oxidizing atmosphere, and thus an oxide film is formed on the surface of the particles, with the result that the resistance of the ferrite particles may be increased (resistance increasing processing). As the oxidizing atmosphere, either of the atmosphere and the mixed atmosphere of oxygen and nitrogen may be used. The heating temperature preferably falls within a range of 200 to 800° C., and more preferably falls within a range of 250 to 600° C. The heating time preferably falls within a range of 0.5 to 5 hours.

The ferrite particles produced as described above are used as the carrier core material of the present invention. Then, in order for the desired chargeability and the like to be obtained, the outer circumference of the carrier core material is coated with a resin, and is used as an electrophotographic development carrier.

As the resin with which the surface of the carrier core material is coated, a conventional known resin can be used. Examples thereof include polyethylene, polypropylene, polyvinyl chloride, poly-4-methylpentene-1, polyvinylidene chloride, ABS (acrylonitrile-butadiene-styrene) resin, polystyrene, (meth) acrylic-based resin, polyvinyl alcohol-based resin, thermoplastic elastomers such as polyvinyl chloride-based, polyurethane-based, polyester-based, polyamide-based and polybutadiene-based thermoplastic elastomers and fluorine silicone-based resins.

In order to coat the surface of the carrier core material with the resin, a solution of the resin or a dispersion solution is preferably applied to the carrier core material. As a solvent for the coating solution, one or two or more types of the followings can be used: aromatic hydrocarbon-based solvents such as toluene and xylene; ketone-based solvents such as acetone, methyl ethyl ketone, methyl isobutyl ketone and cyclohexanone; cyclic ether-based solvents such as tetrahydrofuran and dioxane; alcohol-based solvents such as ethanol, propanol and butanol; cellosolve-based solvents such as ethyl cellosolve and butyl cellosolve; ester-based solvents such as ethyl acetate and butyl acetate; and amide-based solvents such as dimethyl formamide and dimethylacetamide. The concentration of the resin component in the coating solution generally falls within a range of 0.001 to 30 mass %, and particularly preferably falls within a range of 0.001 to 2 mass %.

As a method of coating the carrier core material with the resin, for example, a spray dry method, a fluidized bed method, a spray dry method using a fluidized bed and a dipping method can be used. Among them, the fluidized bed method is particularly preferable because it is possible to efficiently perform coating even with a small amount of resin. For example, in the case of the fluidized bed method, the amount of resin applied can be adjusted by the amount of resin solution sprayed and a spraying time.

With respect to the particle diameter of the carrier, its volume average particle diameter generally falls within a range which is equal to or more than 25 μm but less than 50 μm, and particularly preferably falls within a range which is equal to or more than 30 μm but equal to or less than 40 μm.

The electrophotographic developer according to the present invention is formed by mixing the carrier produced as described above and the toner. The mixing ratio between the carrier and the toner is not particularly limited, and is preferably determined, as necessary, from development conditions of a development device used or the like. In general, the concentration of the toner in the developer preferably falls within a range of 1 to 15 mass %. This is because when the concentration of the toner is less than 1 mass %, an image density is excessively lowered whereas when the concentration of the toner exceeds 15 mass %, the toner is scattered within the development device, and thus a stain within an apparatus may be produced or a failure may occur in which the toner is adhered to a background part of transfer paper or the like. The concentration of the toner more preferably falls within a range of 3 to 10 mass %.

As the toner, a toner can be used which is manufactured by a conventional known method such as a polymerization method, a milling/classification method, a melting granulation method or a spray granulation method. Specifically, a toner can be preferably used in which a coloring agent, a mold release agent, a charge control agent and the like are contained in a binder resin whose main component is a thermoplastic resin.

With respect to the particle diameter of the toner, in general, its volume average particle diameter by a coulter counter preferably falls within a range of 5 to 15 μm, and more preferably falls within a range of 7 to 12 μm.

A modifier may be added to the surface of the toner as necessary. Examples of the modifier include silica, alumina, zinc oxide, titanium oxide, magnesium oxide and polymethyl methacrylate. One or two or more types thereof can be combined and used.

The mixing of the carrier and the toner can be performed with a conventional known mixing device. For example, a Henschel mixer, a V-type mixer, a tumbler mixer and a hybridizer can be used.

Figure 8:
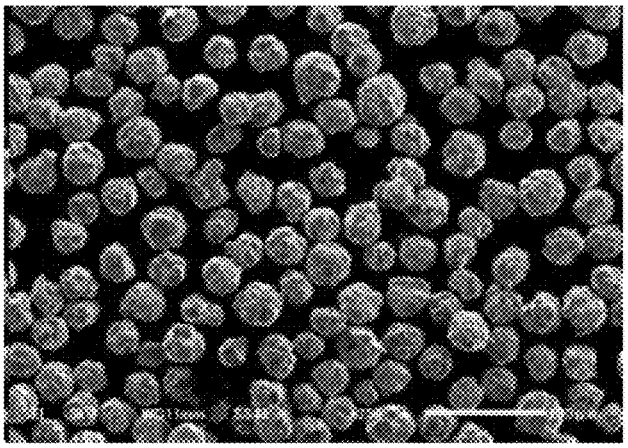
FIG. 8 A SEM photograph of a carrier core material in comparative example 2.
Figure 9:
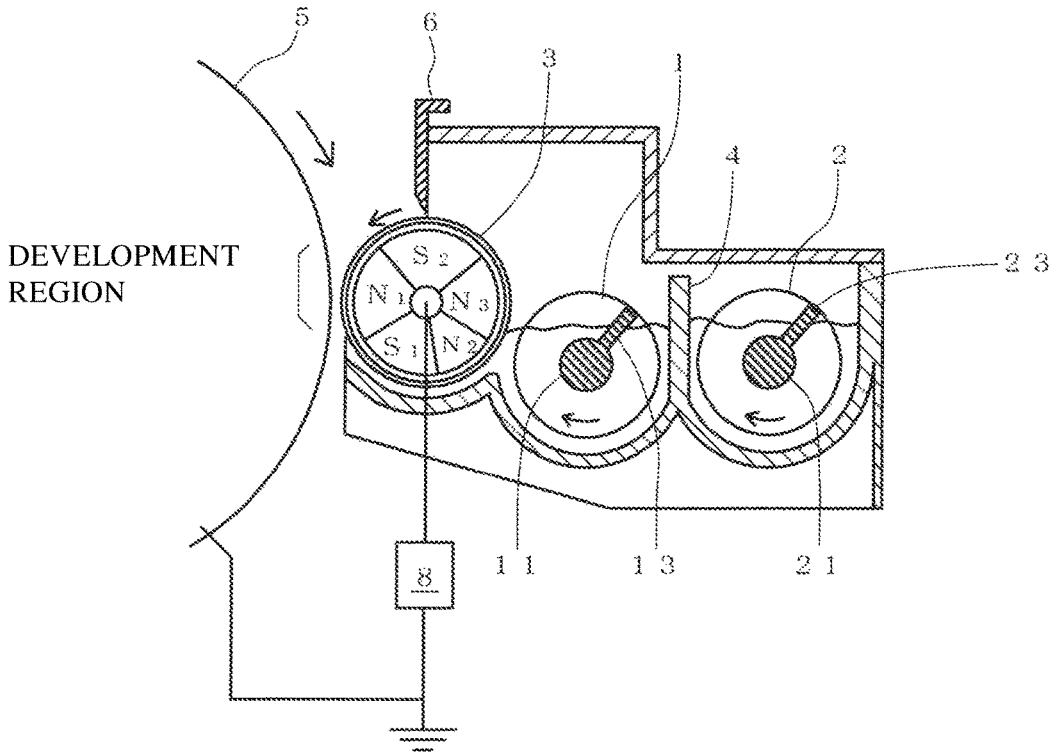
FIG. 9 A schematic diagram showing an example of a development device using a carrier according to the present invention.

Although a development method using the developer of the present invention is not particularly limited, a magnetic brush development method is preferably used. FIG. 8 shows a schematic diagram showing an example of a development device which performs magnetic brush development. The development device shown in FIG. 8 includes: a development roller 3 which incorporates a plurality of magnetic poles and which is freely rotatable; a regulation blade 6 which regulates the amount of developer on the development roller 3 transported to a development portion; two screws 1 and 2 which are arranged parallel to a horizontal direction and which respectively agitate and transport the developer in opposite directions; and a partition plate 4 which is formed between the two screws 1 and 2, which makes it possible to move the developer from one screw to the other screw at both end portions of the screws and which prevents the movement of the developer in the portions other than both the end portions.

In the two screws 1 and 2, spiral blades 13 and 23 are formed at the same inclination angles on shaft portions 11 and 21 and are rotated by an unillustrated drive mechanism in the same direction so as to respectively transport the developer in the opposite directions. At both the end portions of the screws 1 and 2, the developer is moved from one screw to the other screw. In this way, the developer formed with the toner and the carrier is constantly circulated and agitated within the device.

On the other hand, the development roller 3 includes a fixed magnet where within a metallic cylindrical member having concave and convex portions of a few micrometers in its surface, as a magnetic pole generating means, five magnetic poles of a development magnetic pole $N_1$, a transport magnetic pole $S_1$, a separation magnetic pole $N_2$, a pumping magnetic pole $N_3$ and a blade magnetic pole $S_2$ are sequentially arranged. When the development roller 3 is rotated in a direction indicated by an arrow, the developer is pumped up by the magnetic force of the pumping magnetic pole $N_3$ from the screw 1 to the development roller 3. The developer carried on the surface of the development roller 3 is regulated in layer by the regulation blade 6 and is thereafter transported to the development region.

In the development region, a bias voltage obtained by superimposing an alternating-current voltage on a direct-current voltage is applied from a transfer voltage power supply 8 to the development roller 3. The direct-current voltage component of the bias voltage is set to a potential between the potential of a background portion and the potential of an image portion on the surface of a photosensitive drum 5. The potential of the background portion and the potential of the image portion are set to potentials between the maximum value and the minimum value of the bias voltage. The peak-to-peak voltage of the bias voltage preferably falls within a range of 0.5 to 5 kV, and the frequency preferably falls within a range of 1 to 10 kHz. The waveform of the bias voltage may be any waveform such as a rectangular wave, a sine wave or a triangular wave. In this way, the toner and the carrier are vibrated in the development region, the toner is adhered to an electrostatic latent image on the photosensitive drum 5 and thus the development is performed.

Thereafter, the developer on the development roller 3 is transported by the transport magnetic pole $S_1$ into the device, is separated by the separation magnetic pole $N_2$ from the development roller 3, is circulated and transported again by the screws 1 and 2 within the device and is agitated and mixed with the developer which is not subjected to the development. Then, the developer is newly supplied by the pumping magnetic pole $N_3$ from the screw 1 to the development roller 3.

Although in the embodiment shown in FIG. 8, the number of magnetic poles incorporated in the development roller 3 is five, the number of magnetic poles may naturally be increased to 8, 10 or 12 so that the amount of movement of the developer in the development region is further increased or that the pumping property or the like is further enhanced.

EXAMPLES

Although examples of the present invention will be more specifically described below, the present invention is not limited at all to these examples.

Example 1

As raw materials, 7985 g of $Fe_2O_3$ (average particle diameter: 0.6 μm), 3999 g of $Mn_3O_4$ (average particle diameter: 0.9 μm) and 59 g of $SrCO_3$ (average particle diameter: 0.6 μm) were dispersed in 5162 g of pure water, and as a dispersant, 201 g of an ammonium polycarboxylate-based dispersant was added, with the result that a mixture was formed. The mixture was subjected to milling processing with a wet ball mill (medium diameter of 2 mm), and thus mixed slurry was obtained.

The mixed slurry was sprayed with a spray drier into hot air of about 130° C., and thus a dried granulated material having a particle diameter of 10 to 75 μm was obtained. Coarse particles whose particle diameter exceeded 25 μm were removed from the granulated material with a sieve.

The granulated material was put into an electric furnace, and the temperature thereof was increased to 1170° C. in 4.5 hours. Thereafter, the granulated material was held at 1170° C. for 6 hours, and thus calcination was performed. Then, the granulated material was cooled to room temperature in 8 hours. In the meantime, a gas obtained by mixing oxygen and nitrogen was supplied into the furnace such that the concentration of oxygen within the electric furnace was 15000 ppm.

The obtained calcined material was disintegrated once with a hammer mill ("Hammer Crusher NH-34S" made by Sanshou Industry Co., Ltd., screen opening: 1.5 mm), and thus a carrier core material having an average particle diameter of 32.7 μm was obtained. The composition and physical properties of the obtained carrier core material, the maximum peak-to-trough depth Rz, the particle diameter (diameter) ratio in bound particles, the proportion of the bound particles, the properties of a developer and the like were measured with methods described later. The results of the measurements are shown in tables 1 and 2. FIG. 1 shows a SEM photograph of the carrier core material in example 1.

Example 2

Figure 2:
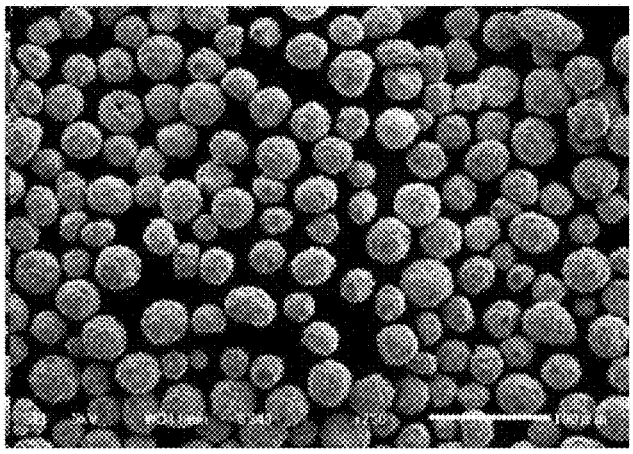
FIG. 2 A SEM photograph of a carrier core material in example 2.

As raw materials, 7985 g of $Fe_2O_3$ (average particle diameter: 0.6 μm), 3557 g of $Mn_3O_4$ (average particle diameter: 0.9 μm) and 76 g of $SrCO_3$ (average particle diameter: 0.6 μm) were dispersed in 4979 g of pure water, and as a dispersant, 201 g of the ammonium polycarboxylate-based dispersant was added, with the result that a mixture was formed. A carrier core material having an average particle diameter of 34.8 μm was obtained by the same method as in example 1 except that the mixture was held at the calcination temperature of 1170° C. for 6 hours and was disintegrated once with the hammer mill (screen opening: 1.5 mm). The composition and physical properties of the obtained carrier core material, the maximum peak-to-trough depth Rz, the particle diameter ratio in the bound particles, the proportion of the bound particles, the properties of the developer and the like were measured with the methods described later. The results of the measurements are shown in tables 1 and 2. FIG. 2 shows a SEM photograph of the carrier core material in example 2.

Example 3

Figure 3:
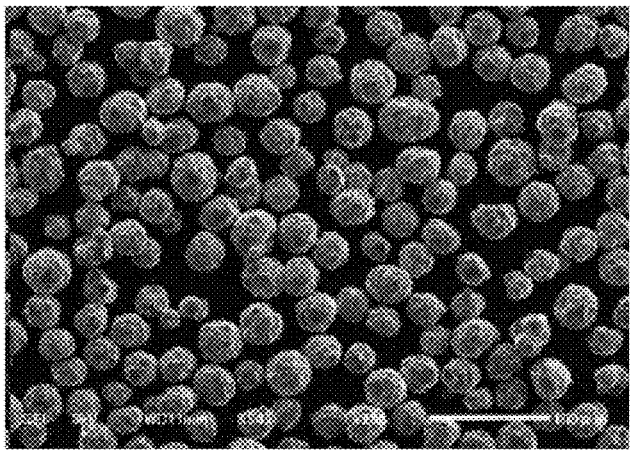
FIG. 3 A SEM photograph of a carrier core material in example 3.

As raw materials, 7985 g of $Fe_2O_3$ (average particle diameter: 0.6 μm), 3788 g of $Mn_3O_4$ (average particle diameter: 0.9 μm) and 113 g of $SrCO_3$ (average particle diameter: 0.6 μm) were dispersed in 5094 g of pure water, and as a dispersant, 201 g of the ammonium polycarboxylate-based dispersant was added, with the result that a mixture was formed. A carrier core material having an average particle diameter of 35.0 μm was obtained by the same method as in example 1 except that the mixture was held at the calcination temperature of 1170° C. for 8 hours, was disintegrated once with the hammer mill (screen opening: 0.3 mm) and was then disintegrated one more time with a pulverizer (made by DOWA Techno Engineering Co., Ltd.). The composition and physical properties of the obtained carrier core material, the maximum peak-to-trough depth Rz, the particle diameter ratio in the bound particles, the proportion of the bound particles, the properties of the developer and the like were measured with the methods described later. The results of the measurements are shown in tables 1 and 2. FIG. 3 shows a SEM photograph of the carrier core material in example 3.

Example 4

Figure 4:
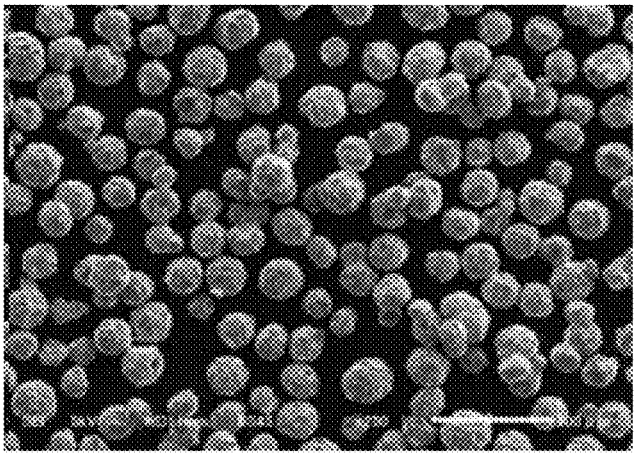
FIG. 4 A SEM photograph of a carrier core material in example 4.

As raw materials, 7985 g of $Fe_2O_3$ (average particle diameter: 0.6 μm), 3806 g of $Mn_3O_4$ (average particle diameter: 0.9 μm) and 110 g of $SrCO_3$ (average particle diameter: 0.6 μm) were dispersed in 5100 g of pure water, and as a dispersant, 201 g of the ammonium polycarboxylate-based dispersant was added, with the result that a mixture was formed. A carrier core material having an average particle diameter of 34.9 μm was obtained by the same method as in example 1 except that the mixture was held at the calcination temperature of 1170° C. for 8 hours, was disintegrated once with the hammer mill (screen opening: 0.3 mm) and was then not disintegrated with the pulverizer (made by DOWA Techno Engineering Co., Ltd.). The composition and physical properties of the obtained carrier core material, the maximum peak-to-trough depth Rz, the particle diameter ratio in the bound particles, the proportion of the bound particles, the properties of the developer and the like were measured with the methods described later. The results of the measurements are shown in tables 1 and 2. FIG. 4 shows a SEM photograph of the carrier core material in example 4.

Example 5

Figure 5:
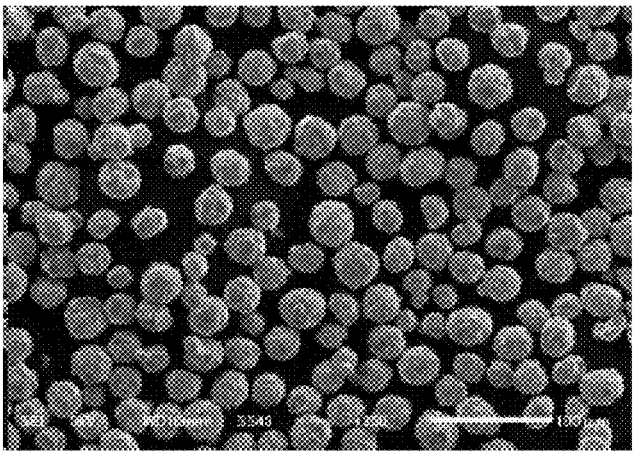
FIG. 5 A SEM photograph of a carrier core material in example 5.

As raw materials, 7985 g of $Fe_2O_3$ (average particle diameter: 0.6 μm), 3789 g of $Mn_3O_4$ (average particle diameter: 0.9 μm) and 113 g of $SrCO_3$ (average particle diameter: 0.6 μm) were dispersed in 5094 g of pure water, and as a dispersant, 201 g of the ammonium polycarboxylate-based dispersant was added, with the result that a mixture was formed. A carrier core material having an average particle diameter of 33.5 μm was obtained by the same method as in example 1 except that the mixture was held at the calcination temperature of 1170° C. for 3 hours, was disintegrated once with the hammer mill (screen opening: 1.5 mm) and was then disintegrated two more times with the pulverizer (made by DOWA Techno Engineering Co., Ltd.). The composition and physical properties of the obtained carrier core material, the maximum peak-to-trough depth Rz, the particle diameter ratio in the bound particles, the proportion of the bound particles, the properties of the developer and the like were measured with the methods described later. The results of the measurements are shown in tables 1 and 2. FIG. 5 shows a SEM photograph of the carrier core material in example 5.

Example 6

Figure 6:
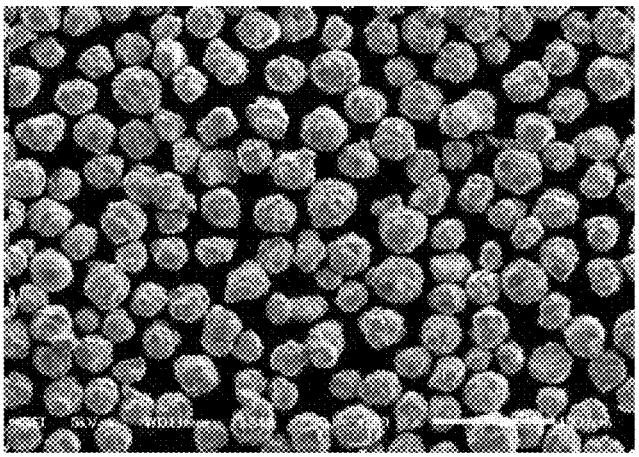
FIG. 6 A SEM photograph of a carrier core material in example 6.

As raw materials, 7985 g of $Fe_2O_3$ (average particle diameter: 0.6 μm), 151 g of MgO (average particle diameter: 0.6 μm), 3403 g of $Mn_3O_4$ (average particle diameter: 0.9 μm) and 39 g of $SrCO_3$ (average particle diameter: 0.6 μm) were dispersed in 4962 g of pure water, and as a dispersant, 201 g of the ammonium polycarboxylate-based dispersant was added, with the result that a mixture was formed. A carrier core material having an average particle diameter of 34.8 μm was obtained by the same method as in example 1 except that the mixture was held at the calcination temperature of 1170° C. for 3 hours, was disintegrated once with the hammer mill (screen opening: 1.5 mm) and was then disintegrated two more times with the pulverizer (made by DOWA Techno Engineering Co., Ltd.). The composition and physical properties of the obtained carrier core material, the maximum peak-to-trough depth Rz, the particle diameter ratio in the bound particles, the proportion of the bound particles, the properties of the developer and the like were measured with the methods described later. The results of the measurements are shown in tables 1 and 2. FIG. 6 shows a SEM photograph of the carrier core material in example 6.

Comparative Example 1

Figure 7:
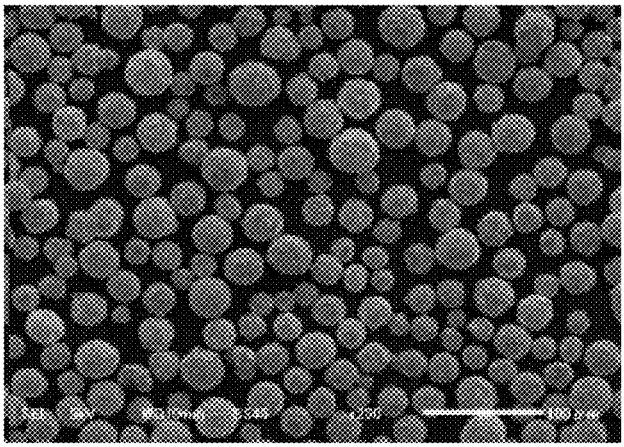
FIG. 7 A SEM photograph of a carrier core material in comparative example 1.

As raw materials, 7985 g of $Fe_2O_3$ (average particle diameter: 0.6 μm), 3104 g of $Mn_3O_4$ (average particle diameter: 0.9 μm) and 57 g of $SrCO_3$ (average particle diameter: 0.6 μm) were dispersed in 4777 g of pure water, and as a dispersant, 201 g of the ammonium polycarboxylate-based dispersant was added, with the result that a mixture was formed. A carrier core material having an average particle diameter of 33.3 μm was obtained by the same method as in example 1 except that the mixture was held at the calcination temperature of 1170° C. for 3 hours, was disintegrated once with the hammer mill (screen opening: 1.5 mm) and was then not disintegrated with the pulverizer (made by DOWA Techno Engineering Co., Ltd.). The composition and physical properties of the obtained carrier core material, the maximum peak-to-trough depth Rz, the particle diameter ratio in the bound particles, the proportion of the bound particles, the properties of the developer and the like were measured with the methods described later. The results of the measurements are shown in tables 1 and 2. FIG. 7 shows a SEM photograph of the carrier core material in comparative example 1.

Comparative Example 2

As raw materials, 7985 g of $Fe_2O_3$ (average particle diameter: 0.6 μm), 3887 g of $Mn_3O_4$ (average particle diameter: 0.9 μm) and 119 g of $SrCO_3$ (average particle diameter: 0.6 μm) were dispersed in 5162 g of pure water, and as a dispersant, 201 g of the ammonium polycarboxylate-based dispersant was added, with the result that a mixture was formed. A carrier core material having an average particle diameter of 34.6 μm was obtained by the same method as in example 1 except that the mixture was held at the calcination temperature of 1170° C. for 8 hours, was disintegrated once with the hammer mill (screen opening: 1.5 mm) and was then disintegrated two more times with the pulverizer (made by DOWA Techno Engineering Co., Ltd.). The composition and physical properties of the obtained carrier core material, the maximum peak-to-trough depth Rz, the particle diameter ratio in the bound particles, the proportion of the bound particles, the properties of the developer and the like were measured with the methods described later. The results of the measurements are shown in tables 1 and 2. FIG. 8 shows a SEM photograph of the carrier core material in comparative example 2.

(Composition Analysis)

(Analysis of Fe)

The carrier core material containing an ion element was weighed and dissolved in mixed acid water of hydrochloric acid and nitric acid. This solution was evaporated to dryness and was thereafter dissolved again by adding sulfuric acid water thereto, and thus excessive hydrochloric acid and nitric acid were volatilized. Solid aluminum was added to this solution, and thus all $Fe^{3+}$ ions in the liquid were reduced to $Fe^{2+}$ ions. Then, the amount of $Fe^{2+}$ irons in this solution was subjected to potentiometric titration using a potassium permanganate solution, and thus quantitative analysis was performed, with the result that the titer of Fe ($Fe^{2+}$) was determined.

(Analysis of Mn)

For the content of Mn in the carrier core material, quantitative analysis was performed according to a ferromanganese analysis method (potentiometric titration method) described in JIS G 1311-1987. The content of Mn in the carrier core material described in the invention of the present application is the amount of Mn which was obtained by performing the quantitative analysis with the ferromanganese analysis method (potentiometric titration method).

(Analysis of Mg)

The content of Mg in the carrier core material was analyzed by the following method. The carrier core material according to the invention of the present application was dissolved in an acid solution, and quantitative analysis was performed by ICP. The content of Mg in the carrier core material described in the invention of the present application is the amount of Mg which was obtained by performing the quantitative analysis with ICP.

(Analysis of Sr)

The content of Sr in the carrier core material was determined by quantitative analysis with ICP as in the analysis of Mg.

(Content Rate and Particle Diameter of Bound Particles)

The shape of the carrier core material was shot with the scanning electron microscope (JSM-6510LA made by JEOL Ltd.) at a magnification of 250. 400 particles were arbitrarily selected from the image shot, the number of bound particles among them was counted and the proportion of the number of bound particles contained in the 400 particles was set to the content rate of the bound particles.

The particle in which 2 to 5 spherical particles were bound together was regarded as the bound particle. Since the bound particle was present in a form in which a bound portion was shared by the spherical particles, the particle diameters of the spherical particles were individually calculated by approximating the particle to a spherical shape from a region obtained by removing the bound portion of the bound particles in the image that was obtained by shooting the shape of the carrier core material with the scanning electron microscope (JSM-6510LA made by JEOL Ltd.) at a magnification of 250.

(Apparent Density)

The apparent density of the carrier core material was measured according to JIS Z 2504.

(Fluidity)

The fluidity of the carrier core material was measured according to JIS Z 2502.

(Average Particle Diameter)

The average particle diameter of the carrier core material was measured with a laser diffraction type particle size distribution measuring device ("Microtrac Model 9320-X100" made by Nikkiso Co., Ltd.).

(Magnetic Properties)

A room-temperature dedicated vibration sample type magnetometer (VSM) ("VSM-P7" made by Toei Industry Co., Ltd.) was used to apply an external magnetic field in a range of 0 to $79.58\times10^4$ A/m (10000 oersteds) continuously in one cycle, and thus saturated magnetization, residual magnetization, a coercive force and magnetization $\sigma_{1k}$ ($Am^2/kg$) in a magnetic field of $79.58\times10^3$ A/m (1000 oersteds) were measured.

(Electrical Resistance)

Two brass plates whose surfaces were electropolished and whose thicknesses were 2 mm were arranged as electrodes such that the distance between the electrodes was 2 mm, 200 mg of the carrier core material was inserted into a gap between the two electrode plates, then a magnet having a cross-sectional area of 240 $mm^2$ was arranged behind each of the electrode plates, in a state where a bridge of powder to be measured was formed between the electrodes, direct-current voltages of 100 V, 250 V, 500 V and 1000 V were applied between the electrodes and thus values of currents flowing through the carrier core material were measured by a four-terminal method. The electrical resistance of the carrier core material was calculated from the current values and the electrode-to-electrode distance of 2 mm and the cross-sectional area of 240 $mm^2$.

(Maximum Peak-to-Trough Depth Rz)

An ultra-deep color 3D shape measuring microscope ("VK-X100" made by Keyence Corporation) was used to observe the surface with a 100× objective lens and thereby determine the maximum peak-to-trough depth Rz. Specifically, ferrite particles were first fixed to an adhesive tape whose surface was flat, a measurement view was determined with the 100× objective lens and thereafter an autofocus function was used to adjust a focal point to the surface of the adhesive tape. A laser beam was applied from a vertical direction (Z direction) to the flat surface of the adhesive tape to which the ferrite particles were fixed, and the surface was scanned in an X direction and in a Y direction. The positions of the heights of the lens when the intensity of light reflected off the surface was maximized were connected together, and thus data in the Z direction was acquired. The pieces of position data in the X, Y and Z directions were connected together, and thus the three-dimensional shape of the surface of the ferrite particles was obtained. In order to capture the three-dimensional shape of the surface of the ferrite particles, an auto-shooting function was used.

The measurements of individual parameters were performed with particle roughness inspection software (made by Mitani Corporation). First, as preprocessing, particle recognition and shape selection were performed on the three-dimensional shape of the surface of the ferrite particles obtained. The particle recognition was performed by the following method. In the three-dimensional shape obtained by the shooting, it was assumed that the maximum value in the Z direction was 100% and that the minimum value in the Z direction was 0%, and the section between the maximum value and the minimum value was divided into 100 equal parts. The region between 35% and 100% was extracted, and the outline of the independent region was recognized as the outline of the particle. Then, particles such as coarse particles, minute particles and associated particles were removed by the shape selection. The shape selection is performed, and thus it is possible to reduce an error at the time of curvature correction to be performed later. Specifically, particles whose area equivalent diameter was equal to or less than 28 μm but equal to or more than 38 μm and whose acicular ratio was equal to or more than 1.15 were removed. Here, the acicular ratio is a parameter which is calculated from a ratio of the maximum length/the diagonal width in the particle, and the diagonal width indicates, when the particle is sandwiched between two straight lines parallel to the maximum length, the shortest distance of the two straight lines.

Then, a portion which was used for analysis was removed from the three-dimensional shape of the surface. First, a square of 15.0 μm was drawn with a barycenter determined from the outline of the particle recognized by the above method being the center. In the drawn square, 21 parallel lines were drawn, and roughness curves on the line segments thereof equivalent to 21 lines were removed.

Since the ferrite particle was formed substantially in the shape of a sphere, the removed roughness curve had a given curvature as a background. Hence, as the correction of the background, the optimal quadratic curve was fitted and was subtracted from the roughness curve. In this case, a low-pass filter was applied with the intensity of 1.5 μm, and a cutoff value λ was set to 80 μm.

The maximum peak-to-trough depth Rz was determined as a sum of the height of the highest peak and the depth of the deepest trough in the roughness curve. The measurement of the maximum height Rz described above was performed according to JIS B0601 (2001 edition). In the calculation of the maximum height Rz, as the average value of the parameters, the average value of 30 particles was used.

(Image Memory)

A carrier was produced by coating the surface of the obtained carrier core material with a resin. Specifically, 450 weight parts of silicone resin and 9 weight parts of (2-aminoethyl) aminopropyl trimethoxysilane were dissolved in 450 weight parts of toluene serving as a solvent, and thus a coat solution was produced. The coat solution was applied with a fluidized bed-type coating device to 50000 weight parts of the carrier core material and was heated with an electric furnace whose temperature was 300° C., and thus the carrier was obtained. Likewise, in all examples and comparative examples which will be described below, the carrier was obtained.

The obtained carrier and a toner whose average particle diameter was about 5.0 μm were mixed with a pot mill for a predetermined time, and thus a two-component electrophotographic developer was obtained. In this case, the carrier and the toner were adjusted such that weight of the toner/(weight of the toner and the carrier)=5/100. Likewise, in all examples and comparative examples which will be described below, the developer was obtained. The obtained developer was put into the development device of a structure shown in FIG. 8 (the peripheral speed of a development sleeve Vs: 406 mm/sec, the peripheral speed of a photosensitive drum Vp: 205 mm/sec and a photosensitive drum-to-development sleeve distance: 0.3 mm), images in which a solid image portion and a non-image portion were adjacent in the longitudinal direction of the photosensitive drum and in which subsequently, a halftone of a wide area was continuous were acquired after the initial image formation and the image formation of 200 thousand sheets, in the second revolution of a development roller, the image densities of a region where a solid image was developed and a region where a solid image was not developed in the first revolution of the development roller were measured with a reflection densitometer (Model Number TC-6D made by Tokyo Denshoku Co., Ltd.) and thus the difference thereof was determined and evaluation was performed with the following criteria. The results are also shown in table 2.

"©": less than 0.003

"O": equal to or more than 0.003 but less than 0.006

"Δ": equal to or more than 0.006 but less than 0.020

"x": equal to or more than 0.020

TABLE 1

| | Composition (mol %) | | | | Powder properties | | | Magnetic properties | | | |
|---|---|---|---|---|---|---|---|---|---|---|---|
| | $Fe_2O_3$ | MgO | MnO | SrO | Apparent density (g/cm$^3$) | Fluidity (sec) | Average particle diameter (μm) | σs Am$^2$/kg | σ 1000 Am$^2$/kg | σr Am$^2$/kg | Hc A/m × $10^3/(4\pi)$ |
| Example 1 | 49 | 0 | 51 | 0.4 | 2.25 | 33.2 | 32.7 | 67.4 | 57.9 | 0.6 | 6.9 |
| Example 2 | 54 | 0 | 46 | 0.5 | 2.24 | 33.0 | 34.8 | 71.9 | 60.3 | 0.7 | 8.7 |
| Example 3 | 51 | 0 | 49 | 0.8 | 2.22 | 40.0 | 35.0 | 69.8 | 59.5 | 1.0 | 10.4 |
| Example 4 | 51 | 0 | 49 | 0.7 | 2.20 | 39.3 | 34.9 | 70.0 | 59.4 | 1.0 | 11.0 |
| Example 5 | 51 | 0 | 49 | 0.8 | 2.26 | 43.3 | 33.5 | 67.6 | 58.3 | 1.0 | 11.2 |
| Example 6 | 53 | 4 | 43 | 0.3 | 2.23 | 33.2 | 34.8 | 71.5 | 60.3 | 0.7 | 8.2 |
| Comparative example 1 | 55 | 0 | 45 | 0.4 | 2.26 | 30.7 | 33.3 | 77.3 | 61.5 | 0.8 | 9.3 |
| Comparative example 2 | 50 | 0 | 50 | 0.8 | 2.25 | 36.9 | 34.6 | 70.0 | 58.2 | 0.8 | 8.8 |

TABLE 2

| | Resistance value (Ω · cm) | | | | $R_2$ | Bound particle diameter | Bound particle proportion | |
|---|---|---|---|---|---|---|---|---|
| | 100 V | 250 V | 500 V | 1000 V | μm | ratio | (%) | Development memory |
| Example 1 | 1.1E+09 | 5.4E+08 | 2.3E+08 | 7.0E+07 | 1.5 | 0.8 | 7 | ○ |
| Example 2 | 1.1E+09 | 5.6E+08 | 2.0E+08 | 5.0E+07 | 1.8 | 0.7 | 7 | © |
| Example 3 | 1.5E+09 | 6.4E+08 | 2.3E+08 | 5.8E+07 | 1.9 | 0.8 | 11 | © |
| Example 4 | 1.3E+09 | 5.9E+08 | 2.1E+08 | 6.1E+07 | 1.9 | 0.8 | 20 | ○ |
| Example 5 | 1.2E+09 | 3.5E+08 | 8.9E+07 | 2.1E+07 | 2.0 | 0.7 | 5 | ○ |
| Example 6 | 2.9E+09 | 1.2E+09 | 4.2E+08 | 1.1E+08 | 2.1 | 0.8 | 5 | ○ |
| Comparative example 1 | 2.3E+08 | 2.1E+08 | 1.8E+08 | 9.3E+07 | 1.3 | 0.8 | 3 | X |
| Comparative example 2 | 2.9E+09 | 1.5E+09 | 8.4E+08 | 3.6E+08 | 2.3 | 0.7 | 4 | Δ |

As is clear from tables 1 and 2, in the developers using the carrier core materials of examples 1 to 6 satisfying the content of the bound particles specified in the present invention, the occurrence of development memory was reduced.

On the other hand, in the developer using the carrier core material of comparative example 1 in which the content of the bound particles was so low as to be 3 number percent and in which the maximum peak-to-trough depth Rz was also so low as to be 1.3 μm, the occurrence of development memory was clearly seen. Even in the developer using the carrier core material of comparative example 2 in which though the maximum peak-to-trough depth Rz fell within the range specified in the present invention so as to be 2.3 μm, the content of the bound particles was so low as to be 4 number percent, the occurrence of development memory was seen.

INDUSTRIAL APPLICABILITY

According to the carrier core material of the present invention, it is useful that it is possible to increase the amount of toner supplied to a development region, and that the surface of a photosensitive member is prevented from being scratched by a magnetic brush.

REFERENCE SIGNS LIST

3 development roller
5 photosensitive drum
C carrier

The invention claimed is:

1. A carrier core material that is represented by a composition formula $M_xFe_{3-x}O_4$ (where M is Mn and/or Mg, and X is a total of Mn and Mg and is a substitution number of Fe by Mn and Mg, $0<X\leq1$), wherein 5 to 20 number percent of bound particles in which 2 to 5 spherical particles are bound together are contained, and a maximum peak-to-trough depth Rz of a surface of normal spherical particles other than the bound particles is equal to or more than 1.5 μm but equal to or less than 2.1 μm.

2. The carrier core material according to claim 1, wherein a volume average particle diameter is equal to or more than 25 μm but less than 50 μm.

3. An electrophotographic development carrier, wherein a surface of the carrier core material according to claim 1 is coated with a resin.

4. An electrophotographic developer comprising:

the electrophotographic development carrier according to claim 3; and a toner.

5. An electrophotographic development carrier, wherein a surface of the carrier core material according to claim 2 is coated with a resin.

6. An electrophotographic developer comprising:

the electrophotographic development carrier according to claim 5; and a toner.

* * * * *